United States Patent [19]

Johnson et al.

[11] 4,362,171

[45] Dec. 7, 1982

[54] CIGARETTE FILTER

[75] Inventors: Robert R. Johnson, Louisville; Daniel V. Cantrell, Prospect, both of Ky.

[73] Assignee: Brown & Williamson Tobacco Corporation, Louisville, Ky.

[21] Appl. No.: 208,951

[22] Filed: Nov. 21, 1980

[51] Int. Cl.[3] ..... A24D 3/04

[52] U.S. Cl. ..... 131/336

[58] Field of Search ..... 131/336, 339, 340, 338, 131/198 R, 198 A, 216, 219

[56] References Cited

U.S. PATENT DOCUMENTS

| | | | |
|---|---|---|---|
| 3,490,461 | 1/1970 | Osmalov et al. | 131/336 |
| 3,910,288 | 10/1975 | Hammersmith et al. | 131/340 |
| 4,256,122 | 3/1981 | Johnson | 131/336 |

FOREIGN PATENT DOCUMENTS

| | | | |
|---|---|---|---|
| 1531543 | 5/1968 | France | 131/336 |

*Primary Examiner*—V. Millin

*Attorney, Agent, or Firm*—Charles G. Lamb

[57] ABSTRACT

A filter for a cigarette includes a porous filter rod circumscribed by a smoke impervious wrapper wherein the filter rod with the non-porous wrapper therearound is provided with at least one groove therein extending a preselected distance longitudinally therealong. The groove is closed at one end and is provided with an opening substantially at the other end in flow communication with the filter rod. Tipping material circumscribes the wrapper and is provided with flow-through openings therein in flow communication with the groove wherein ventilating air is the only fluid flowing through the groove when the filter is used in combination with a cigarette during normal smoke draw.

6 Claims, 7 Drawing Figures

CIGARETTE FILTER

BACKGROUND OF THE INVENTION

1. Field of the Invention

This invention relates to filters for cigarettes. In one aspect, it relates to a filter with novel ventilating means therein. In another aspect the invention relates to a filter cigarette having flow directing grooves therein for directing ventilating air therethrough.

2. Description of the Prior Art

It is well known in the art to add filters to cigarettes wherein the filters are provided with ventilating means to bring ambient air into the filter to dilute the smoke stream. The dilution of the smoke stream reduces the quantity of smoke particulates as well as gas phase components which are delivered to the mouth of the smoker. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough thereby diluting the smoke in the stream. Also, the cigarette wrapper may be perforated at selected locations along the length of the cigarette which provides ports for the cigarette through which ventilating air enters. Even further, it is known to perforate the wrapper of the filter on the filter end of the cigarette to allow for ventilating air to enter the filter for dilution of the smoke stream. There have also been a number of suggestions for incorporating grooves within the filter plug for the cigarette in order to facilitate the addition of ventilating air into the smoke stream.

For example, U.S. Pat. No. 3,596,663 relates to a tobacco smoke filter provided with a corrugated porous plug wrap surrounding a filter element which is circumscribed by tipping paper having flow-through perforations therein whereby ventilating air enters directly into the filter element or progresses down the grooves to the smokers mouth. Other patents which relate to cigarette filters having grooves circumscribing the filter element for the introduction of ventilating air into the filtering end of the filter cigarette include U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; U.S. Pat. No. 3,608,561; and, U.S. Pat. No. 3,910,288.

SUMMARY OF THE INVENTION

The present invention advantageously provides a straight forward arrangement of a filter for a cigarette which in one form achieves normal cigarette pressure drop with low to moderate efficiency filters. The present invention further provides in one form a cigarette filter for lowering tar predominantly by ventilation instead of filtration. The present invention even further provides a filter ventilation system for a cigarette utilizing a groove in the filter plug extending longitudinally thereof, with one end closed and the other end having an opening in flow communication with filter media. The present invention also provides a grooved filter with a smoke impervious plug wrap.

Various other features of the present invention will become obvious to those skilled in the art upon reading the disclosure set forth hereinafter.

More particularly, the present invention provides a filter for a cigarette comprising a porous filter rod of cylindrical configuration; a smoke impervious wrapper extending longitudinally of and circumscribing the rod leaving flow-through opposed ends of the rod, the wrapper and rod having at least one longitudinally extending groove embedded into the filter rod and the wrapper, the groove having an opening in one end opening into the filter rod, the groove extending a preselected distance therealong less than the length of the filter rod; and, tipping material extending longitudinally of and circumscribing the wrapper, the tipping material including flow-through openings therein in flow communication with the groove.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENTS

Figure 1:
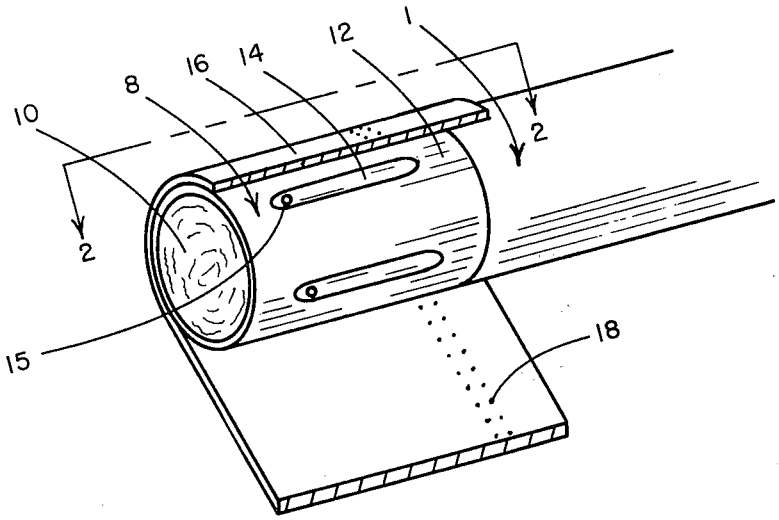
FIG. 1 is a perspective view of one preferred filter element of the present invention attached to a cigarette with tipping material shown in an unwrapped condition of one embodiment.

In FIG. 1, a filter plug 8 of the present invention is shown attached to a tobacco column 1. The filter plug 8 comprises a cellulose acetate filter element 10 or any other filter made from fibrous or foamed materials for tobacco smoke which may be known in the art circumscribed by a non-porous or smoke impervious wrapper 12. It is realized that in the use of the term "smoke impervious" or "non-porous wrapper", this includes non-porous outer surfaces of foamed material which are integral with the filter element as well as non-porous wrapping material which is not integral with the filter element. The filter plug 8 is provided with a plurality of grooves 14 therein extending longitudinally therealong. It is realized that the grooves 14 are shown as being in parallel, but they may also be angled to the central-axis as well as angled in respect to each other as they extend longitudinally along the filter plug 8. The filter plug 8 is generally prepared by taking a standard filter rod of cellulose acetate or the like, wrapping the rod with a non-porous wrapping material, then subjecting the wrapped filter rod to a mold or other treating means designed for putting appropriate grooves therein. One such method is known as a heat molding technique, which is well known in the art. Tipping material 16 having flow-through perforations 18 therein circumscribes the wrapper 12, perforations 18 being in alignment with grooves 14.

Figure 2:
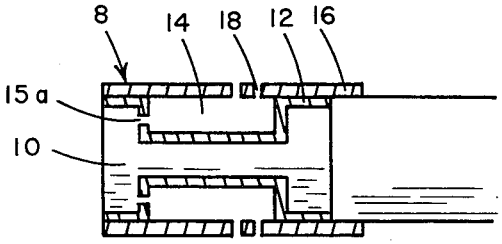
FIG. 2 is a sectional view of FIG. 1 taken in a plane passing through line 2—2 of FIG. 1 where ventilating air leaves the groove longitudinally of the filter rod.

In FIG. 2, the grooves 14 are of a preselected length less than the filter rod 10 and extend toward the mouth end of the rod 10 with an opening 15*a* therein, opening 15*a* being disposed to direct ventilating air longitudinally of the filter rod towards the mouth end of the filter rod and adjacent thereto. (In FIG. 2, the numeral 15*a* corresponds to the opening 15 in FIG. 1 and 15*b* in FIG. 3 corresponds to opening 15 in FIG. 1.) The distance or spacing between the opening 15 and the mouth end of the filter rod is generally determined so that the ventilating air enters the smoker's mouth with minimal mixing with smoke passing through the filter under normal smoke draw.

Figure 3:
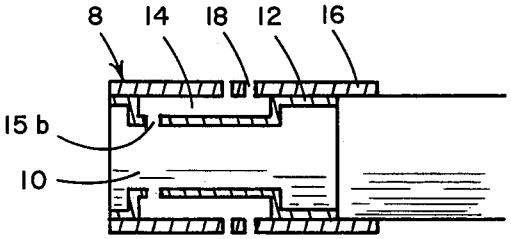
FIG. 3 is a sectional view similar to FIG. 2 with the ventilating air leaving the groove transverse of the filter rod.

In FIG. 3, the opening 15*b* is disposed to direct ventilating air transverse to the flow of smoke through the filter so it is mixed therewith just prior to entering the smoker's mouth. It is realized that, even though FIG. 3 shows opening 15*b* extending transversely just into the filter rod, opening 15*b* could be a channel that extends into, for example, the center of the filter rod so the smoke stream in the center of the filter is mixed with ventilating air just prior to entering the smoker's mouth during normal smoke draw.

Figure 4:
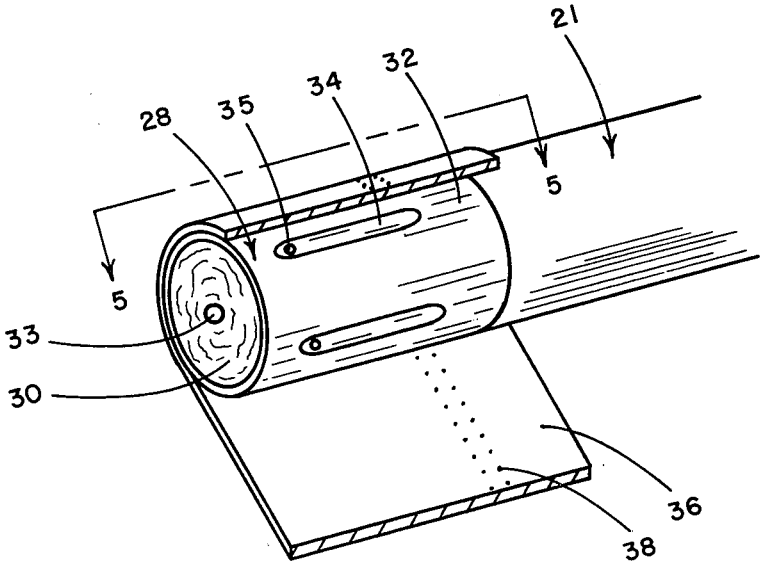
FIG. 4 is a perspective view of another preferred filter element of the present invention attached to a cigarette with tipping material shown in an unwrapped condition.

FIG. 4 shows a filter plug 28 attached to a tobacco column 21. Filter plug 28 is comprised of a filter element 30 which may be cellulose acetate, or any other filter element known in the art, circumscribed by a non-porous wrapper 32 and includes a plurality of grooves 34 extending longitudinally of the plug a preselected distance therealong. Centrally disposed of the filter rod 30 is a channel 33 which extends co-axially from end to end of the filter rod 30 whereby smoke flows unfiltered from the tobacco column to the smoker's mouth under normal smoke draw. Grooves 34 are provided with openings 35 therein to provide for the passage of ventilating air transversely into the element 30.

Figure 5:
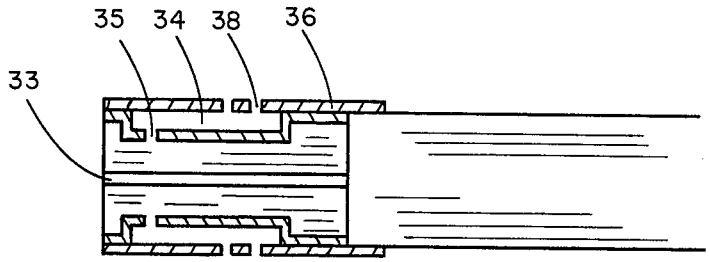
FIg. 5 is a sectional view of the filter element of FIG. 4 taken in a plane passing through line 5—5.

As shown in FIG. 5, ventilating air is directed into or in the direction of channel 33 to mix with and dilute the unfiltered smoke passing therethrough. It is realized that the opening may be disposed for directing ventilating air in the same manner as openings 15*a* and 15*b* in FIGS. 2 and 3 respectively. In the method of preparing a filter plug, the same procedure is utilized as mentioned hereinbefore in discussion of the preparation of the filter plug in FIG. 1. In use of the filter plug 28 of FIG. 4, but attaching the filter plug 28 to a cigarette or tobacco column 21, the plug is circumscribed by tipping material 36 which includes a pair of parallel rows of ventilating perforations 38, perforations 38 are disposed for flow-through alignment with grooves 34. In use, ventilating air travels into groove 34, then out through opening 35 into channel 33 where it is mixed with smoke from tobacco column 21.

Figure 6:
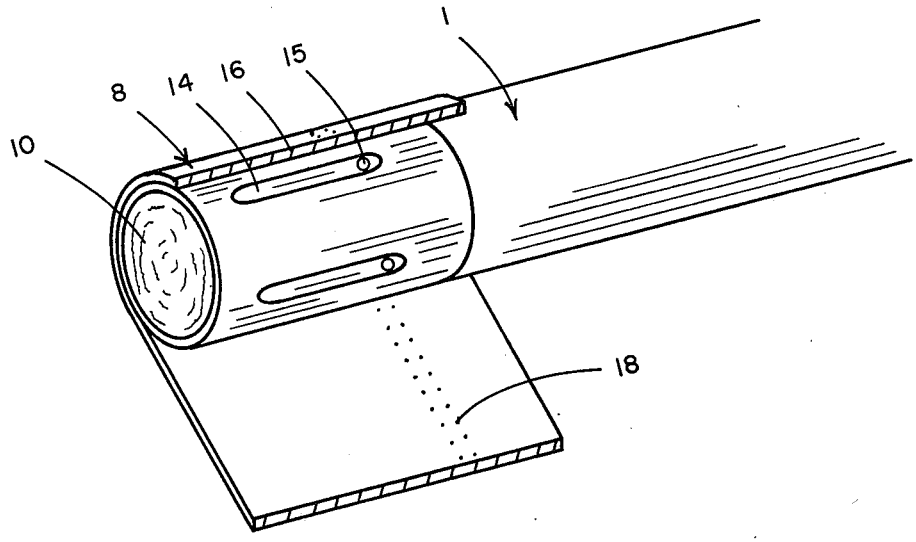
FIG. 6 is a perspective view of even another preferred filter element of the present invention attached to a cigarette with tipping material shown in an unwrapped condition; and, FIG. 7 is a perspective view of even another preferred filter element of the present invention attached to a cigarette with tipping material shown in an unwrapped condition.

In FIG. 6, the filter plug 8 of FIG. 1 is turned around and attached to a tobacco column 1 so the ventilating air leaving the groove 14 through opening 15 is directed toward the tobacco end of the filter.

Figure 7:
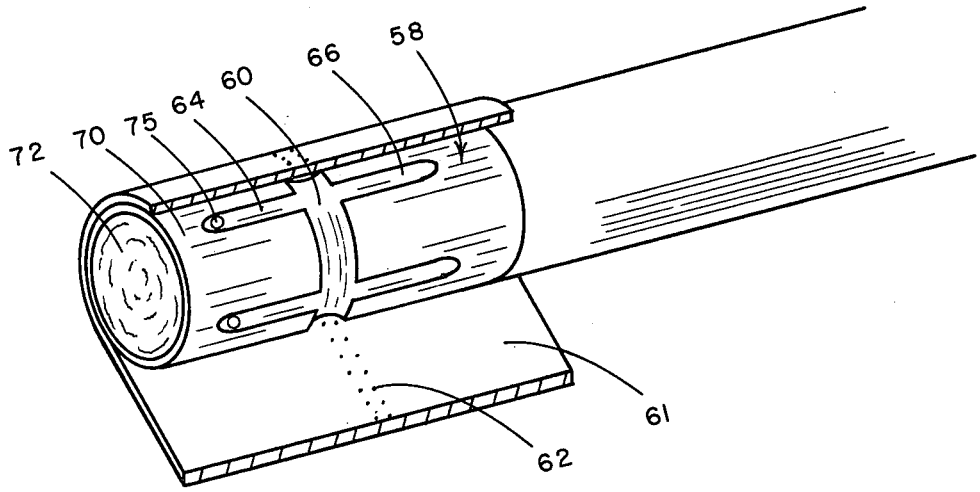

In FIG. 7, a filter plug 58 is provided with a circumferentially extending groove 60 disposed for alignment with perforations 62 in a tipping paper 61. Circumferential groove 60 is in flow communication with opposed axially aligned grooves 64 and 66, groove 64 extending toward one end of the filter plug 58 and groove 60 extending toward the other. Grooves 60, 64 and 66 are embedded into non-porous plug wrap 70 and filter element 72, plug wrap 70 circumscribing filter element 72. An opening 75 is provided in one end of groove 64 to provide means for ventilating air to enter the filter element during normal smoke draw.

It will be realized that various changes may be made to the specific embodiments shown and described without departing from the principles of the present invention.

What is claimed is:

1. A filter rod for a cigarette comprising:

a porous filter rod of cylindrical configuration;

a smoke impervious wrapper extending longitudinally along said rod from one end thereof and circumscribing said rod leaving flow-through opposed ends of said rod, said wrapper having at least one longitudinally extending groove embedded into the filter rod and that portion of the wrapper defining the groove remaining smoke impervious, said groove having an opening in one end into the filter rod, said groove extending a distance less than the length of the filter rod intermediate of both ends; and, tipping material extending longitudinally of and circumscribing said wrapper, said tipping material being air pervious and permitting ventilating air flow therethrough into said groove, said ventilating air being the only fluid flowing through said groove when the filter is used in combination with a cigarette during normal smoke draw.

2. The filter of claim 1 in combination with a cigarette, said groove opening being adjacent to the mouth end of the filter.

3. The filter of claim 2 in combination with a cigarette, said groove opening having means to direct flow transverse into said filter rod.

4. The filter of claim 2 in combination with a cigarette, said groove opening having means to direct flow longitudinally into said filter rod toward the mouth end of said filter.

5. The filter of claim 1 wherein said tipping material is permeable to air.

6. The filter of claim 1, including a circumferentially extending groove in flow communication with said longitudinally extending groove, said circumferentially extending groove being embedded into said filter rod and said wrapper.

* * * * *